US010053939B2

(12) United States Patent
Merron et al.

(10) Patent No.: US 10,053,939 B2
(45) Date of Patent: Aug. 21, 2018

(54) DISSOLVABLE AND MILLABLE ISOLATION DEVICES

(71) Applicant: Halliburton Energy Services, Inc., Houston, TX (US)

(72) Inventors: Matthew J. Merron, Carrollton, TX (US); Zachary W. Walton, Carrollton, TX (US); John Todd Broome, Denver, CO (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/115,613

(22) PCT Filed: Jan. 26, 2015

(86) PCT No.: PCT/US2015/012963
§ 371 (c)(1),
(2) Date: Jul. 29, 2016

(87) PCT Pub. No.: WO2016/122451
PCT Pub. Date: Aug. 4, 2016

(65) Prior Publication Data

US 2017/0335645 A1 Nov. 23, 2017

(51) Int. Cl.
*E21B 29/02* (2006.01)
*E21B 33/12* (2006.01)

(52) U.S. Cl.
CPC ..... *E21B 29/02* (2013.01); *E21B 33/12* (2013.01)

(58) Field of Classification Search
CPC ..... E21B 33/1204; E21B 29/02
See application file for complete search history.

(56) References Cited

U.S. PATENT DOCUMENTS

| | | | | |
|---|---|---|---|---|
| 5,415,696 | A * | 5/1995 | Paul | C09K 8/528 134/10 |
| 2011/0048743 | A1 | 3/2011 | Stafford et al. | |
| 2012/0118583 | A1 | 5/2012 | Johnson et al. | |
| 2012/0292053 | A1* | 11/2012 | Xu | E21B 33/134 166/387 |
| 2013/0319669 | A1 | 12/2013 | Dupree et al. | |
| 2013/0333891 | A1 | 12/2013 | Fripp et al. | |
| 2014/0027127 | A1 | 1/2014 | Frazier et al. | |
| 2014/0332233 | A1 | 11/2014 | Walton | |

FOREIGN PATENT DOCUMENTS

WO 2014123657 A1 8/2014

OTHER PUBLICATIONS

International Search Report and Written Opinion dated Oct. 6, 2015; International PCT Application No. PCT/US2015/012963.
Netherlands Search Report dated Oct. 25, 2016, Netherlands Application No. 1041636.

* cited by examiner

*Primary Examiner* — Cathleen R Hutchins
(74) *Attorney, Agent, or Firm* — McGuire Woods LLP

(57) ABSTRACT

A method of removing a wellbore isolation device comprising: causing or allowing at least a portion of the isolation device to undergo a phase transformation in the wellbore; and milling at least a portion of the isolation device that does not undergo the phase transformation.

18 Claims, 3 Drawing Sheets

DISSOLVABLE AND MILLABLE ISOLATION DEVICES

TECHNICAL FIELD

An isolation device and methods of removing the isolation device are provided. According to an embodiment, the isolation device is used in an oil or gas well operation.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 1:
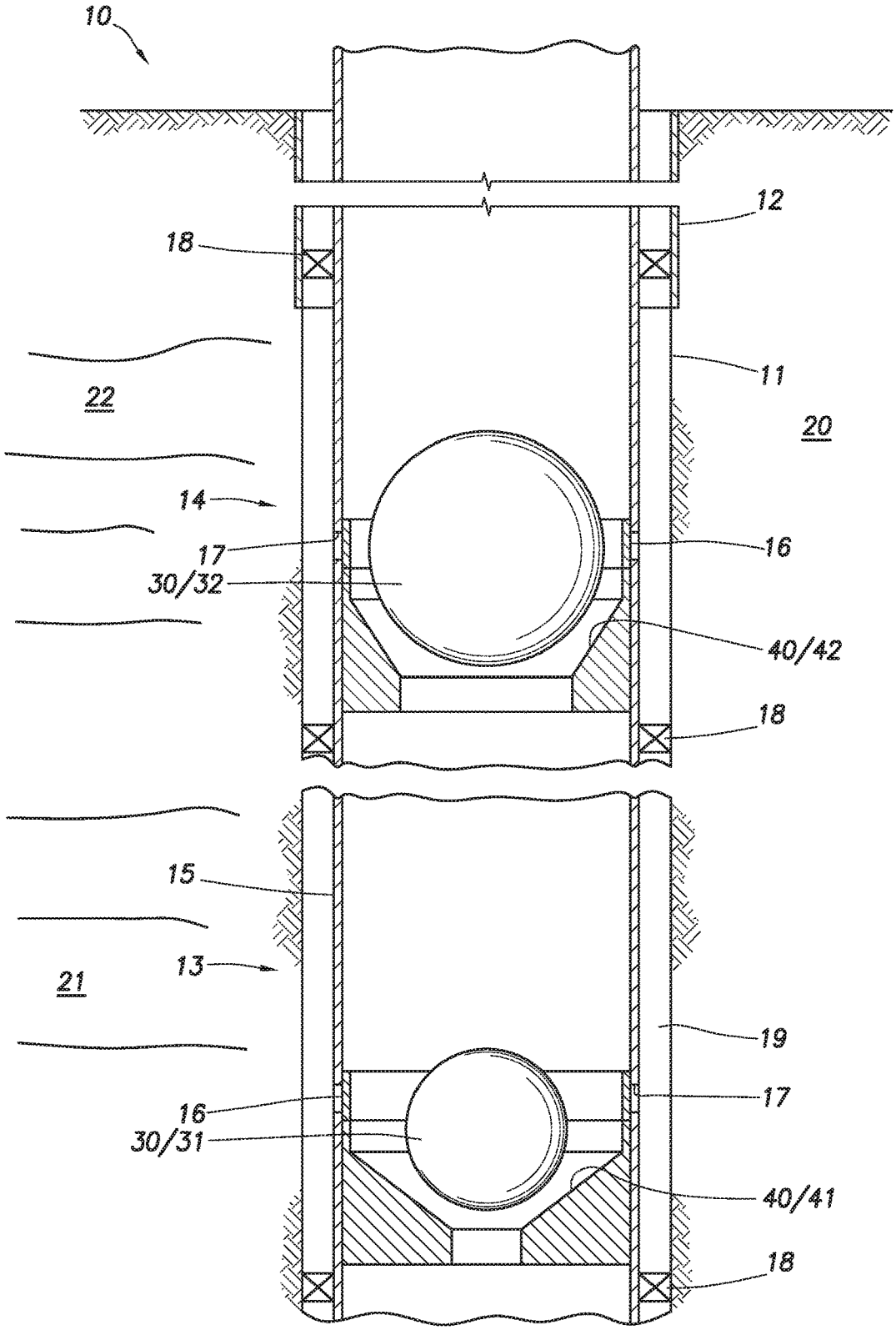
FIG. 1 depicts a well system containing more than one isolation device.

Oil and gas hydrocarbons are naturally occurring in some subterranean formations. In the oil and gas industry, a subterranean formation containing oil or gas is referred to as a reservoir. A reservoir may be located under land or off shore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir. The oil, gas, or water produced from a reservoir is called a reservoir fluid. As used herein, a "fluid" is a substance having a continuous phase that tends to flow and to conform to the outline of its container when the substance is tested at a temperature of 71° F. (22° C.) and a pressure of one atmosphere "atm" (0.1 megapascals "MPa"). A fluid can be a liquid or gas. A homogenous fluid has only one phase; whereas a heterogeneous fluid has more than one distinct phase. A heterogeneous fluid can be: a slurry, which includes an external liquid phase and undissolved solid particles as the internal phase; an emulsion, which includes an external liquid phase and at least one internal phase of immiscible liquid droplets; a foam, which includes an external liquid phase and a gas as the internal phase; or a mist, which includes an external gas phase and liquid droplets as the internal phase.

A well can include, without limitation, an oil, gas, or water production well, or an injection well. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. The well can also include multiple wellbores, such as a main wellbore and lateral wellbores. As used herein, the term "wellbore" also includes a main wellbore as well as lateral wellbores that branch off from the main wellbore or from other lateral wellbores. A near-wellbore region is the subterranean material and rock of the subterranean formation surrounding the wellbore. As used herein, a "well" also includes the near-wellbore region. The near-wellbore region is generally considered to be the region within approximately 100 feet radially of the wellbore. As used herein, "into a well" means and includes into any portion of the well, including into the wellbore or into the near-wellbore region via the wellbore.

In an open-hole wellbore portion, a tubing string may be placed into the wellbore. The tubing string allows fluids to be introduced into or flowed from a remote portion of the wellbore. In a cased-hole wellbore portion, a casing is placed into the wellbore that can also contain a tubing string. A wellbore can contain an annulus. Examples of an annulus include, but are not limited to: the space between the wellbore and the outside of a tubing string in an open-hole wellbore; the space between the wellbore and the outside of a casing in a cased-hole wellbore; the space between the inside of a casing and the outside of a tubing string in a cased-hole wellbore; the space between a well tool and a casing in a cased-hole wellbore portion, and the space between a well tool and a wellbore wall in an open-hole wellbore portion.

It is not uncommon for a wellbore to extend several hundreds of feet or several thousands of feet into a subterranean formation. The subterranean formation can have different zones. A zone is an interval of rock differentiated from surrounding rocks on the basis of its fossil content or other features, such as faults or fractures. For example, one zone can have a higher permeability compared to another zone. It is often desirable to treat one or more locations within multiples zones of a formation. One or more zones of the formation can be isolated within the wellbore via the use of an isolation device to create multiple wellbore intervals. At least one wellbore interval corresponds to a formation zone. The isolation device can be used for zonal isolation and functions to block fluid flow within a tubular, such as a tubing string, or within an annulus. The blockage of fluid flow prevents the fluid from flowing across the isolation device in any direction and isolates the zone of interest. In this manner, treatment techniques can be performed within the zone of interest.

Common isolation devices include, but are not limited to, a ball and a seat, a bridge plug, a frac plug, a packer, a plug, and wiper plug. It is to be understood that reference to a "ball" is not meant to limit the geometric shape of the ball to spherical, but rather is meant to include any device that is capable of engaging with a seat. A "ball" can be spherical in shape, but can also be a dart, a bar, or any other shape. Zonal isolation can be accomplished via a ball and seat by dropping or flowing the ball from the wellhead onto the seat that is located within the wellbore. The ball engages with the seat, and the seal created by this engagement prevents fluid communication into other wellbore intervals downstream of the ball and seat. As used herein, the relative term "downstream" means at a location further away from a wellhead. In order to treat more than one zone using a ball and seat, the wellbore can contain more than one ball seat. For example, a seat can be located within each wellbore interval. Generally, the inner diameter (I.D.) of the ball seats is different for each zone. For example, the I.D. of the ball seats sequentially decreases at each zone, moving from, the wellhead to the bottom of the well. In this manner, a smaller ball is first dropped into a first wellbore interval that is the farthest downstream; the corresponding zone is treated; a slightly larger ball is then dropped into another wellbore interval that is located upstream of the first wellbore interval; that corresponding zone is then treated; and the process continues in this fashion—moving upstream along the wellbore—until all the desired zones have been treated. As used herein, the relative term "upstream" means at a location closer to the wellhead.

It should be understood that, as used herein, "first," "second," "third," etc., are arbitrarily assigned and are merely intended to differentiate between two or more zones, isolation devices, wellbore intervals, etc., as the case may be, and does not indicate any particular orientation or sequence. Furthermore, it is to be understood that the mere use of the term "first" does not require that there be any "second," and the mere use of the term "second" does not require that there be any "third," etc.

A bridge plug and frac plug are composed primarily of slips, a plug mandrel, and a sealing element. A bridge plug and frac plug can be introduced into a wellbore and the sealing element can be caused to block fluid flow into downstream intervals. The setting of a plug can be performed by engaging an anchoring device with an inside of a component in the wellbore and/or sealingly engaging an annular seal element with the inside of the component, where the inside of the component can be an inner diameter of a casing in a cased wellbore, an inner diameter of the wall of the wellbore in an uncased wellbore, or an inner diameter of a tubing string in the wellbore. A packer generally consists of a sealing device, a holding or setting device, and an inside passage for fluids. A packer can be used to block fluid flow through the annulus, for example, located between the outside of a tubular and the wall of the wellbore or inside of a casing.

Isolation devices can be classified as permanent or retrievable. While permanent isolation devices are generally designed to remain in the wellbore after use, retrievable devices are capable of being removed after use. It is often desirable to use a retrievable isolation device in order to restore fluid communication between one or more wellbore intervals. Traditionally, isolation devices are retrieved by inserting a retrieval tool into the wellbore, wherein the retrieval tool engages with the isolation device, attaches to the isolation device, and the isolation device is then removed from the wellbore. Another way to remove an isolation device from the wellbore is to mill at least a portion of the device or the entire device. Yet, another way to remove an isolation device is to contact the device with a solvent, such as an acid, thus dissolving all or a portion of the device. Yet another way to remove an isolation device is to cause or allow all or a portion of the isolation device to melt or dissolve or otherwise undergo a phase transformation within the wellbore.

However, some of the disadvantages to using traditional methods to remove a retrievable isolation device include: it can be difficult and time consuming to use a retrieval tool; complete milling of the isolation device can be time consuming and costly and produce too much debris in the wellbore; premature dissolution of the isolation device can occur; incomplete phase transformations could occur; and it can be quite costly to fully dissolve the isolation device. For example, premature dissolution can occur if acidic fluids are used in the well prior to the time at which it is desired to dissolve the isolation device.

Thus, there is a need for improved isolation devices and methods of removing. A novel method of removing an isolation device includes causing or allowing at least a portion of the isolation device to undergo a phase transformation and concurrently or subsequently milling some or all of the remaining portion of the isolation device to remove it from the wellbore. Examples of mechanisms by which the material can dissolve or undergo a phase transformation include, but are not limited to, galvanic corrosion, dissolution in a solvent or electrolyte, melting, and chemical reactions such as hydrolysis.

Galvanic corrosion occurs when two different metals or metal alloys are in electrical connectivity with each other and both are in contact with an electrolyte. As used herein, the phrase "electrical connectivity" means that the two different metals or metal alloys are either touching or in close enough proximity to each other such that when the two different metals are in contact with an electrolyte, the electrolyte becomes electrically conductive and ion migration occurs between one of the metals and the other metal, and is not meant to require an actual physical connection between the two different metals, for example, via a metal wire. It is to be understood that as used herein, the term "metal" is meant to include pure metals and also metal alloys without the need to continually specify that the metal can also be a metal alloy. Moreover, the use of the phrase "metal or metal alloy" in one sentence or paragraph does not mean that the mere use of the word "metal" in another sentence or paragraph is meant to exclude a metal alloy. As used herein, the term "metal alloy" means a mixture of two or more elements, wherein at least one of the elements is a metal. The other element(s) can be a non-metal or a different metal. An example of a metal and non-metal alloy is steel, comprising the metal element iron and the non-metal element carbon. An example of a metal and metal alloy is bronze, comprising the metallic elements copper and tin.

The metal that is less noble, compared to the other metal, will dissolve in the electrolyte. The less noble metal is often referred to as the anode, and the more noble metal is often referred to as the cathode. Galvanic corrosion is an electrochemical process whereby free ions in the electrolyte make the electrolyte electrically conductive, thereby providing a means for ion migration from the anode to the cathode—resulting in deposition formed on the cathode. Certain metal alloys, such as a single metal alloy containing at least 50% magnesium, can dissolve in an electrolyte without a distinct cathode being present.

A material can melt or undergo a phase transformation at the bottomhole temperature of a well. As used herein, the term "bottomhole" means at the location of the isolation device. As used herein, a "phase transformation" means any change that occurs to the physical properties of the substance. As used herein, a "phase transformation" can include, without limitation, dissolution in a solvent or via galvanic corrosion, a change in the phase of the substance (i.e., from a solid to a liquid or semi-liquid, from a liquid or semi-liquid to a gas, etc.), a glass transition, a change in the amount of crystallinity of the substance, physical changes to the amorphous and/or crystalline portions of the substance, and any combinations thereof. A substance will undergo a phase transformation at a "phase transformation temperature." As used herein, a "phase transformation temperature" includes a single temperature and a range of temperatures at which the substance undergoes a phase transformation. By way of example, a substance will have a glass transition temperature or range of temperatures, symbolized as $T_g$. The $T_g$ of a substance is generally lower than its melting temperature $T_m$. The glass transition can occur in the amorphous regions of the substance.

A material can be a eutectic composition or a fusible alloy. A fusible alloy can also be a eutectic composition. As used herein, the term "fusible alloy" means an alloy wherein at least one phase of the alloy has a melting point below 482° F. (250° C.). A eutectic composition is a mixture of two or more substances that undergoes a phase transformation at a lower temperature than all of its pure constituent components. Stated another way, the temperature at which a eutectic composition undergoes the phase transformation is a lower temperature than any composition made up of the same substances can freeze or melt and is referred to as the transformation temperature. A solid-liquid phase transformation temperature can also be referred to as the freezing point or melting point of a substance or composition. The substances making up the eutectic composition can be compounds, such as metal alloys or thermoplastics, or metallic elements. By way of example, the melting point of bismuth at atmospheric pressure (101 kilopascals) is 520° F. (271° C.) and the melting point of lead is 621° F. (327° C.); however, the melting point of a composition containing 55.5% bismuth and 44.5% lead has a melting point of 244° F. (118° C.). As can be seen the bismuth-lead composition has a much lower melting point than both, elemental bismuth and elemental lead. Not all compositions have a melting point that is lower than all of the individual substances making up the composition. By way of example, a composition of silver and gold has a higher melting point compared to pure silver, but is lower than that of pure gold. Therefore, a silver-gold composition cannot be classified as a eutectic composition.

A eutectic composition can also be differentiated from other compositions because it solidifies (or melts) at a single, sharp temperature. It is to be understood that the phrases "phase transformation" and "solid-liquid phase transformation," the term "melt" and all grammatical variations thereof, and the term "freeze" and all grammatical variations thereof are meant to be synonymous. Non-eutectic compositions generally have a range of temperatures at which the composition melts. There are other compositions that can have both: a range of temperatures at which the composition melts; and a melting point less than at least one of the individual substances making up the composition. These other substances can be called hypo- and hyper-eutectic compositions. A hypo-eutectic composition contains the minor substance (i.e., the substance that is in the lesser concentration) in a smaller amount than in the eutectic composition of the same substances. A hyper-eutectic composition contains the minor substance in a larger amount than in the eutectic composition of the same substances. Generally, with few exceptions, a hypo- and hyper-eutectic composition will have a solid-liquid phase transformation temperature higher than the eutectic transformation temperature but less than the melting point of at least one of the individual substances making up the composition.

According to an embodiment, a method of removing a wellbore isolation device comprises: causing or allowing at least a portion of the isolation device to undergo a phase transformation in the wellbore; and milling at least a portion of the isolation device that does not undergo the phase transformation.

Turning to the Figures, FIG. 1 depicts a well system 10. The well system 10 can include at least one wellbore 11. The wellbore 11 can include a casing 12. The wellbore 11 can include only a generally vertical wellbore section or can include only a generally horizontal wellbore section. A tubing string 15 can be installed in the wellbore 11. The wellbore 11 can penetrate a subterranean formation 20. The subterranean formation 20 can be a portion of a reservoir or adjacent to a reservoir. The subterranean formation 20 can include a first zone 21 and a second zone 22. The well system 10 can comprise at least a first wellbore interval 13 and a second wellbore interval 14. The well system 10 can also include more than two wellbore intervals, for example, the well system 10 can further include a third wellbore interval, a fourth wellbore interval, and so on. At least one wellbore interval can correspond to a zone of the subterranean formation 20. The well system 10 can further include one or more packers 18. The packers 18 can be used in addition to the isolation device to create the wellbore intervals and isolate each zone of the subterranean formation 20, for example to isolate the first zone 21 from the second zone 22. The isolation device can be the packers 18. The packers 18 can be used to prevent fluid flow between one or more wellbore intervals (e.g., between the first wellbore interval 13 and the second wellbore interval 14) via an annulus 19. The tubing string 15 can also include one or more ports 17. One or more ports 17 can be located in each wellbore interval. Moreover, not every wellbore interval needs to include one or more ports 17. For example, the first wellbore interval 13 can include one or more ports 17, while the second wellbore interval 14 does not contain a port. In this manner, fluid flow into the annulus 19 for a particular wellbore interval can be selected based on the specific oil or gas operation.

It should be noted that the well system 10 is illustrated in the drawings and is described herein as merely one example of a wide variety of well systems in which the principles of this disclosure can be utilized. It should be clearly understood that the principles of this disclosure are not limited to any of the details of the well system 10, or components thereof, depicted in the drawings or described herein. Furthermore, the well system 10 can include other components not depicted in the drawing. For example, the well system 10 can further include a well screen. By way of another example, cement may be used instead of packers 18 to aid the isolation device in providing zonal isolation. Cement may also be used in addition to packers 18.

According to certain embodiments, the isolation device restricts or prevents fluid flow between a first wellbore interval 13 and a second wellbore interval 14. The first wellbore interval 13 can be located upstream or downstream of the second wellbore interval 14. In this manner, depending on the oil or gas operation, fluid is restricted or prevented from flowing downstream or upstream into the second wellbore interval 14. Examples of isolation devices capable of restricting or preventing fluid flow between zones include, but are not limited to, a ball and a ball seat, a plug, a bridge plug, a wiper plug, a frac plug, a packer, and a plug in a base pipe.

At least a portion of the isolation device undergoes a phase transformation. According to certain embodiments, the portion of the isolation device that undergoes the phase transformation is the mandrel of a packer or plug, a spacer ring, a slip, a wedge, a retainer ring, an extrusion limiter or backup shoe, a mule shoe, a portion of a ball, a flapper, a portion of a ball seat, or a portion of a sleeve.

As depicted in the drawings, the isolation device can be a ball 30 (e.g., a first ball 31 or a second ball 32) and a seat 40 (e.g., a first seat 41 or a second seat 42). The ball 30 can engage the seat 40. The seat 40 can be located on the inside of a tubing string 15. The inner diameter (I.D.) of the first seat 41 can be less than the I.D. of the second seat 42. In this manner, a first ball 31 can be dropped or flowed into wellbore. The first ball 31 can have a smaller outer diameter (O.D.) than the second ball 32. The first ball 31 can engage the first seat 41. Fluid can now be temporarily restricted or prevented from flowing into any wellbore intervals located downstream of the first wellbore interval 13. In the event it is desirable to temporarily restrict or prevent fluid flow into any wellbore intervals located downstream of the second wellbore interval 14, then the second ball 32 can be dropped or flowed into the wellbore and will be prevented from falling past the second seat 42 because the second ball 32 has a larger O.D. than the I.D. of the second seat 42. The second ball 32 can engage the second seat 42. The ball (whether it be a first ball 31 or a second ball 32) can engage a sliding sleeve 16 during placement. This engagement with the sliding sleeve 16 can cause the sliding sleeve to move; thus, opening a port 17 located adjacent to the seat. The port 17 can also be opened via a variety of other mechanisms instead of a ball. The use of other mechanisms may be advantageous when the isolation device is not a ball. After placement of the isolation device, fluid can be flowed from, or into, the subterranean formation 20 via one or more opened ports 17 located within a particular wellbore interval. As such, a fluid can be produced from the subterranean formation 20 or injected into the formation.

The methods can further include the step of placing the isolation device in a portion of the wellbore 11, wherein the step of placing is performed prior to the steps of causing or allowing and milling. More than one isolation device can also be placed in multiple portions of the wellbore. The step of placing the isolation device can include setting the device within the wellbore or causing swelling and/or expansion of a sealing element into engagement with the inside surface of a wellbore component. The wellbore component can be an inner diameter of a casing in a cased wellbore, an inner diameter of the wall of the wellbore in an uncased wellbore, or an inner diameter of a tubing string in the wellbore.

At least a portion of the isolation device comprises a material that undergoes a phase transformation in the wellbore. The material can be a metal, metal alloy, the anode of a galvanic system, a eutectic composition, a hyper- or hypo-eutectic composition, a thermoplastic, polymeric wax, or a fusible alloy. The material can undergo the phase transformation via galvanic dissolution, dissolution in a suitable solvent (e.g., an acid), hydrolysis, or any other chemical reaction, such as dissolution in an electrolyte without a distinct cathode being present or hydrolytic dissolution of polymer bonds. The material can also undergo a phase transformation by melting, for example, when the material is a eutectic composition, a hyper- or hypo-eutectic composition, a thermoplastic, polymeric wax, or a fusible alloy. The metal or metal of the metal alloy can be selected from the group consisting of, lithium, sodium, potassium, rubidium, cesium, beryllium, calcium, strontium, barium, radium, aluminum, gallium, indium, tin, thallium, lead, bismuth, scandium, titanium, vanadium, chromium, manganese, thorium, iron, cobalt, nickel, copper, zinc, yttrium, zirconium, niobium, molybdenum, ruthenium, rhodium, palladium, praseodymium, silver, cadmium, lanthanum, hafnium, tantalum, tungsten, terbium, rhenium, osmium, iridium, platinum, gold, neodymium, gadolinium, erbium, oxides of any of the foregoing, graphite, carbon, silicon, boron nitride, oxides of any of the foregoing, and any combinations thereof. Preferably, the metal or metal of the metal alloy is selected from the group consisting of magnesium, aluminum, zinc, beryllium, tin, iron, nickel, copper, oxides of any of the foregoing, and combinations thereof.

The isolation device can further include a second material. The second material can be the cathode of a galvanic system, a filler material, a strengthening material, an electrolytic compound (i.e., a compound that forms an electrolyte upon dissolution in a solvent), a buffering agent, or combinations thereof. A filler material or strengthening material can be selected from the group consisting of sand, plastic granules, ceramic granules, ceramic beads, fibers, whiskers, woven materials, ceramic microspheres, hollow glass microspheres, and combinations thereof.

The methods include causing or allowing at least a portion of the isolation device to undergo the phase transformation in the wellbore 11. The step of causing can include introducing a heated fluid into the wellbore when the material undergoes the phase transformation via an increase in temperature. The step of allowing can include a cessation of pumping a cooling fluid into the wellbore and allowing the bottomhole temperature to increase to the subterranean formation temperature when the material undergoes the phase transformation via an increase in temperature. The step of causing can include introducing an electrolyte into the wellbore or introducing a solvent for an electrolytic compound contained within the isolation device when the material is part of a galvanic system or dissolves in an electrolyte without a distinct cathode being present. The step of causing can also include introducing a suitable solvent, such as an acid, into the wellbore to cause dissolution of the portion of the isolation device. The step of allowing can include allowing a reservoir fluid to come in contact with the material, wherein the reservoir fluid is an electrolyte or solvent for the material.

As used herein, an electrolyte is any substance containing free ions (i.e., a positive- or negative-electrically charged atom or group of atoms) that make the substance electrically conductive. The electrolyte can be selected from the group consisting of, solutions of an acid, a base, a salt, and combinations thereof. A salt can be dissolved in water, for example, to create a salt solution. Common free ions in an electrolyte include sodium ($Na^+$), potassium ($K^+$), calcium ($Ca^{2+}$), magnesium ($Mg^{2+}$), chloride ($Cl^-$), hydrogen phosphate ($HPO_4^{2-}$), and hydrogen carbonate ($HCO_3^-$). If more than one electrolyte is used, the free ions in each electrolyte can be the same or different. A first electrolyte can be, for example, a stronger electrolyte compared to a second electrolyte. Furthermore, the concentration of each electrolyte can be the same or different. It is to be understood that when discussing the concentration of an electrolyte, it is meant to be a concentration prior to contact with the portion of the isolation device that undergoes the phase transformation, as the concentration of the electrolyte will decrease during the galvanic corrosion reaction or dissolution.

The methods further include milling at least a portion of the isolation device that does not undergo the phase transformation. Accordingly, the isolation device can include one or more components or areas that undergo the phase transformation and one or more components or areas that do not undergo a phase transformation. By way of example, an outer housing of a plug can be made of a material that does not undergo a phase transformation, while the mandrel of the plug can be made of a material that undergoes the phase transformation.

Figure 2:
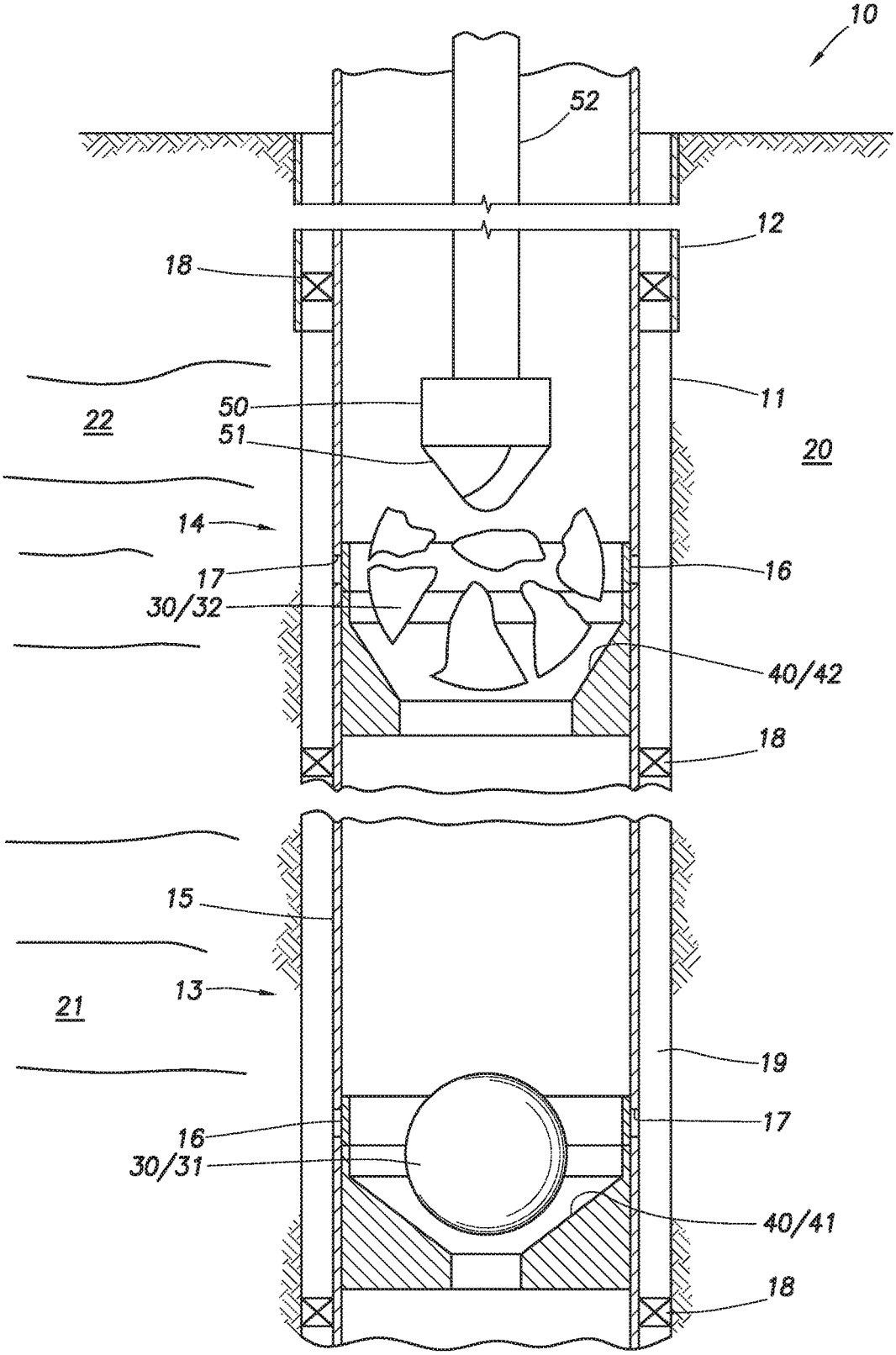
FIG. 2 depicts an isolation device being milled within a wellbore.

Turning to FIG. 2, the step of milling can include introducing a mill 50 into the wellbore 11 on a conveyance 52. As used herein, "conveyance" refers to a means of transporting a well tool, such as the mill, through a tubing string. For example, the conveyance can be a coiled tubing, a wireline, a tractor system, a segmented tubing string, etc. The mill 50 can include a mill bit 51. The step of milling can include breaking the portion of the isolation device that does not undergo the phase transformation into smaller pieces or fragments. The mill bit 51 can be used to break a portion of the isolation device into smaller pieces or fragments, shown in FIG. 2. The milling of the portion of the isolation device can be performed according to techniques commonly known to those skilled in the art. The particular mill 50 and the mill bit 51 can also be selected to mill the portion of the isolation device, and one of ordinary skill in the art will be able to make such a selection based on the specifics for the isolation device.

The step of milling can further include introducing a treatment fluid through the mill bit 51 as the mill 50 is used to break up the portion of the isolation device. According to certain embodiments, the treatment fluid causes the portion of the isolation device to undergo the phase transformation. By way of example, the treatment fluid can be an electrolyte, heated fluid, or solvent (e.g., an acid) for causing the portion of the isolation device to undergo the phase transformation. In this manner, the step of causing or allowing is performed simultaneously with the step of milling. Accordingly, the treatment fluid causes the portion of the isolation device to undergo the phase transformation while the mill 50 is used to mill the portions of the isolation device that do not undergo the phase transformation. The milled pieces or fragments of the isolation device as well as the portion that underwent the phase transformation can then be removed from the well.

According to certain other embodiments, the step of causing or allowing is performed prior to the step of milling. According to these embodiments, one or more components or areas of the isolation device undergo the phase transformation via the introduction of a suitable phase transforming fluid or allowing the temperature surrounding the isolation device to increase, for example. The components or areas of the isolation device that did not undergo the phase transformation can then be milled using the mill 50.

The methods can further include the step of removing the portion of the isolation device that underwent the phase transformation, the pieces or fragments of the milled portion of the isolation device, or both portions of the isolation device. The step of removing can include flowing the dissolved portions of the isolation device and the pieces or fragments from the wellbore 11.

According to certain embodiments, the isolation device withstands a specific pressure differential for a desired amount of time. As used herein, the term "withstands" means that the substance does not crack, break, or collapse. The pressure differential can be the downhole pressure of the subterranean formation 20 across the device. As used herein, the term "downhole" means the location of the wellbore where the isolation device is located. Formation pressures can range from about 1,000 to about 30,000 pounds force per square inch (psi) (about 6.9 to about 206.8 megapascals "MPa"). The pressure differential can also be created during oil or gas operations. For example, a fluid, when introduced into the wellbore 11 upstream or downstream of the isolation device, can create a higher pressure above or below, respectively, of the isolation device. Pressure differentials can range from 100 to over 10,000 psi (about 0.7 to over 68.9 MPa).

The portion of the isolation device that undergoes the phase transformation can undergo the phase transformation in a desired amount of time. The desired amount of time can be pre-determined, based in part, on the specific oil or gas well operation to be performed as well as the amount of time needed to mill out the undissolved portions of the isolation device. The desired amount of time can be in the range from about 1 hour to about 2 months, preferably about 5 to about 10 days. The isolation device can include one or more tracers (not shown). The tracer(s) can be, without limitation, radioactive, chemical, electronic, or acoustic. A tracer can be useful in determining real-time information on the rate of phase transformation of the material. By being able to monitor the presence of the tracer, workers at the surface can make on-the-fly decisions that can affect the rate of phase transformation of the material. Such decisions might include increasing or decreasing the concentration of an electrolyte or solvent.

There are several factors that can affect the rate at which the material undergoes the phase transformation. For galvanic corrosion, the greater the difference between the two materials' anodic index, the faster the rate of dissolution. Also, the size, shape, and distribution pattern of the anode and cathode can be used to help control the rate of dissolution of the anodic material. The concentration of the electrolyte can also affect the rate of dissolution.

The rate at which the temperature increases can also affect the rate of the phase transformation, such as to cause melting or changes in the crystallinity of the material.

Figure 3:
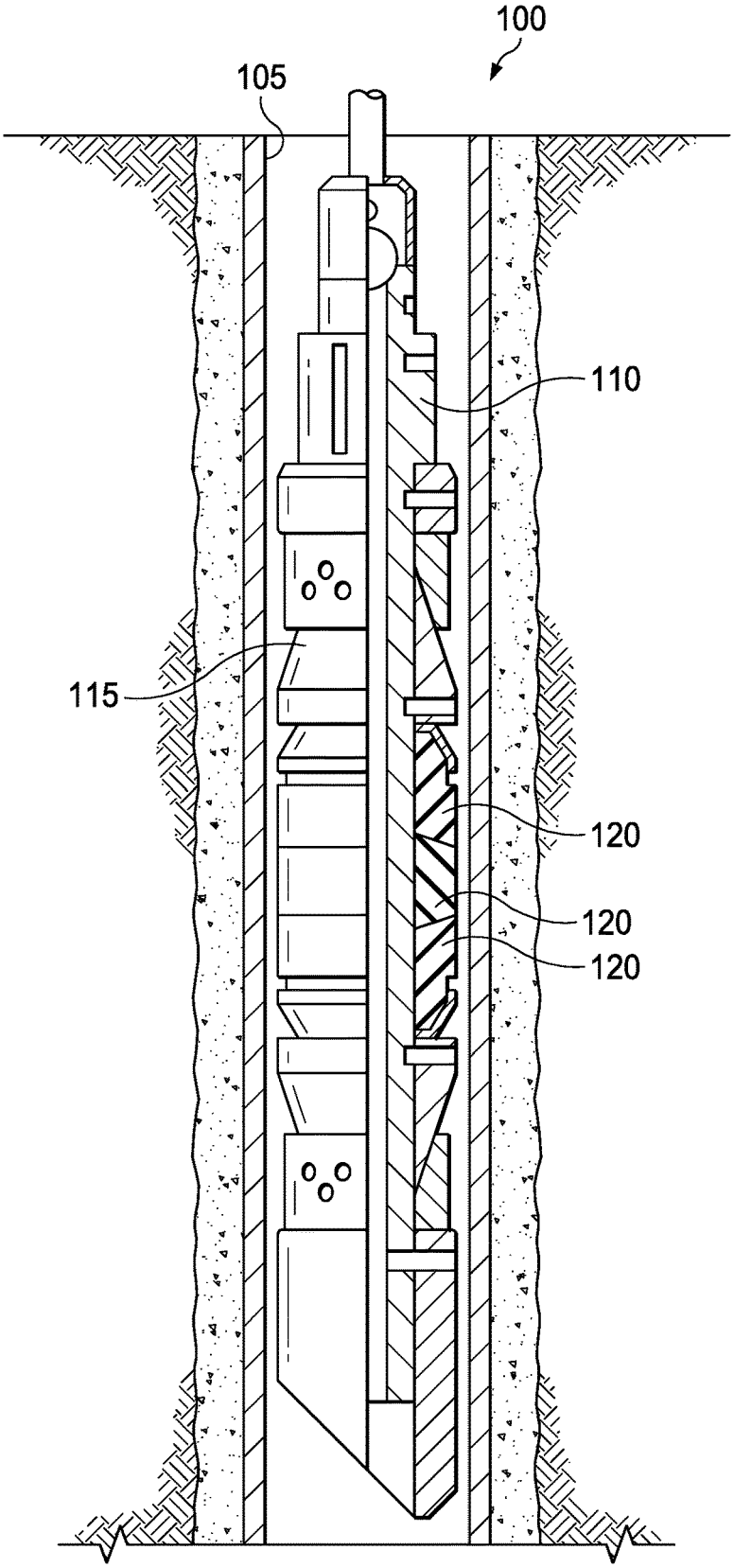
FIG. 3 depicts a partial cross-section of a frac plug disposed with a wellbore.

Referring to FIG. 3, a partial cross-section of a frac plug 100 disposed within wellbore 105 is illustrated. The frac plug 100 comprises mandrel 110, outer housing 115, and sealing elements 120. Sealing elements 120 may be caused to block fluid flow into downstream intervals. Mandrel 110 may be made of a material that undergoes a phase transformation. Outer housing 115 may be made of a material that does not undergo a phase transformation. At least a portion of outer housing 115 may be milled through.

Therefore, the present system is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention. As used herein, the words "comprise," "have," "include," and all grammatical variations thereof are each intended to have an open, non-limiting meaning that does not exclude additional elements or steps. While compositions and methods are described in terms of "comprising," "containing," or "including" various components or steps, the compositions and methods also can "consist essentially of" or "consist of" the various components and steps.

Whenever a numerical range with a lower limit and an upper limit is disclosed, any number and any included range falling within the range is specifically disclosed. In particular, every range of values (of the form, "from about a to about b," or, equivalently, "from, approximately a to b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A method of removing a wellbore isolation device comprising:

causing or allowing at least a portion of the isolation device to undergo a phase transformation in the wellbore; and milling at least a portion of the isolation device that does not undergo the phase transformation; wherein the wellbore isolation device is a frac plug comprising a mandrel and an outer housing; wherein at least a portion of the mandrel undergoes the phase transformation in the wellbore; wherein the outer housing does not undergo the phase transformation in the wellbore; wherein the at least a portion of the mandrel that undergoes the phase transformation undergoes the phase transformation in the range of from about 1 hour to about 2 months.

2. The method according to claim 1, wherein the isolation device restricts or prevents fluid flow between a first wellbore interval and a second wellbore interval.

3. The method according to claim 1, wherein the isolation device is selected from a ball and a ball seat, a plug, a bridge plug, a wiper plug, a frac plug, a packer, and a plug in a base pipe.

4. The method according to claim 1, further comprising placing the isolation device in the wellbore prior to the steps of causing or allowing and milling.

5. The method according to claim 1, wherein at least a portion of the isolation device comprises a material that undergoes the phase transformation in the wellbore.

6. The method according to claim 5, wherein the material undergoes the phase transformation via galvanic dissolution, dissolution in a suitable solvent, hydrolysis, any other chemical reaction, dissolution in an electrolyte without a distinct cathode being present, or hydrolytic dissolution of polymer bonds.

7. The method according to claim 6, wherein the material is selected from the group consisting of a metal, metal alloy, the anode of a galvanic system, a eutectic composition, a hyper- or hypo-eutectic composition, a thermoplastic, polymeric wax, a fusible alloy, and combinations thereof.

8. The method according to claim 7, wherein the metal or metal of the metal alloy is selected from the group consisting of magnesium, aluminum, zinc, beryllium, tin, iron, nickel, copper, oxides of any of the foregoing, and combinations thereof.

9. The method according to claim 1, wherein the isolation device further comprises a second material.

10. The method according to claim 9, wherein the second material is the cathode of a galvanic system, a filler material, a strengthening material, an electrolytic compound, a buffering agent, or combinations thereof.

11. The method according to claim 1, wherein the step of causing comprises introducing a heated fluid into the wellbore.

12. The method according to claim 1, wherein the step of causing comprises introducing an electrolyte into the wellbore or introducing a solvent for an electrolytic compound contained within the isolation device into the wellbore.

13. The method according to claim 1, wherein the step of causing comprises introducing a solvent for the portion of the isolation device that undergoes the phase transformation into the wellbore.

14. The method according to claim 1, wherein the step of milling comprises introducing a mill into the wellbore.

15. The method according to claim 14, wherein the step of milling further comprises introducing a treatment fluid through a mill bit of the mill.

16. The method according to claim 15, wherein the step of causing or allowing is performed simultaneously with the step of milling, and wherein the treatment fluid causes the portion of the isolation device to undergo the phase transformation.

17. The method according to claim 1, wherein the step of causing or allowing is performed prior to the step of milling.

18. The method according to claim 1, further comprising removing the portion of the isolation device that underwent the phase transformation, pieces or fragments of the portion of the isolation device that was milled, or both the portion of the isolation device that underwent the phase transformation and the pieces or fragments from the wellbore.

* * * * *